US006133813A

United States Patent [19]

Hanke et al.

[11] Patent Number: 6,133,813

[45] Date of Patent: Oct. 17, 2000

[54] ELECTROMAGNETIC RELAY

[75] Inventors: Martin Hanke; Thomas Buescher, both of Berlin, Germany

[73] Assignee: Siemens Electromechanical Components GmbH & Co. KG, Munich, Germany

[21] Appl. No.: 09/401,593

[22] Filed: Sep. 22, 1999

[30] Foreign Application Priority Data

Sep. 23, 1998 [DE] Germany ..... 198 43 617

[51] Int. Cl.[7] ..... H01H 51/22

[52] U.S. Cl. ..... 335/78; 335/80; 335/84; 335/85; 335/124; 335/274

[58] Field of Search ..... 335/78–86, 124, 335/128, 274, 275, 276

[56] References Cited

U.S. PATENT DOCUMENTS 4,870,378 9/1989 Biehl et al. ..... 335/128
5,003,274 3/1991 Chikira et al. ..... 335/83
5,095,294 3/1992 Chikira et al. ..... 335/78

FOREIGN PATENT DOCUMENTS 0 278 495 6/1992 European Pat. Off. .

*Primary Examiner*—M. L. Gellner
*Assistant Examiner*—Raymond Barrera
*Attorney, Agent, or Firm*—Hill & Simpson

[57] ABSTRACT

A relay has a leaf spring that is secured to a planar seating section of a yoke leg and/or to the planar seating section of the armature and has an unsecured spring section extending beyond the free end of the yoke leg or, respectively, the armature. In order to avoid a plastic deformation of the leaf spring given impacts, the planar seating section respectively merges into a convexly curved roll-off section of which the leaf spring rolls off given a blow without being bent permanently. The end of the roll-off motion is expediently limited by a detent and, in this way, it is assured that the relay does not suffer any permanent modifications of its characteristics, even given heavy blows.

16 Claims, 1 Drawing Sheet

ELECTROMAGNETIC RELAY

BACKGROUND OF THE INVENTION

The present invention is directed to an electromagnetic relay having a contact arrangement and a magnet system, which system comprises a yoke and an armature movably seated on the yoke and a leaf spring that has a fastening section fastened to lie planarly on a planar seating surface of a rigid carrier formed by either the yoke and/or the armature and has an adjoining, unsecured spring section extending beyond a free end of the carrier, so that the spring section has a predetermined motion latitude perpendicular to the plane of the fastening section.

A relay of this type is known and frequently employed. Examples of such a relay are disclosed in U.S. Pat. No. 4,870,378, whose disclosure is incorporated herein by reference thereto and which claims priority from the same German Application as European Patent 0 278 495. In this relay, a leaf spring that is connected both to the yoke as well as to the armature serves both as an armature bearing spring as well as forming a contact spring projecting beyond a free end of the armature. In the known relay, the yoke end on which the armature is seated forms a sharp edge, and the leaf spring extends planarly on the yoke up to this edge. Likewise, the free end of the armature forms a sharp edge beyond which the free end of the leaf spring extends and carries a movable contact on this end section, which extends planarly lying thereagainst.

When a relay of the above-described structure falls to the ground from a specific height, the armature moves relative to the yoke upon impact and relative to the remaining, stationary parts of the relay. Such a motion can lead to a plastic deformation of the spring for a corresponding impact direction, and this will cause an unintended modification of the electrical parameters of the relay beyond a justifiable extent. When, for example, the armature thus experiences a movement perpendicular to the seating plane of the leaf spring on the yoke upon impact, the leaf spring can be bent over the yoke edge and be plastically deformed. When the armature experiences a blow in a direction perpendicular thereto, for example in the direction of the coil axis or, respectively, of the yoke plane, then the contact legs of the leaf spring can be bent over the terminating edge of the free end of the armature and be plastically deformed given a correspondingly strong impact.

SUMMARY OF THE INVENTION

The object of the present invention is to construct a relay in which a permanent deformation of the leaf spring is avoided and which greatly reduces, in terms, the effect given impact stresses.

In a relay having the initial design, this goal is inventively achieved in that a roll-off area for the leaf spring has a wedge shape in the quiescent state or condition, which is formed between the seating section and the free end of the carrier, and this region is formed by a convex curvature of a roll-off section of either the carrier or the leaf spring away from the plane of the seating section.

Given the inventive design of the relay, it is assured that the leaf spring that, in the relaxed condition, usually extends from the planar seating section essentially straight beyond the end of the carrier and does not lie directly on an edge in the region of this carrier end. To accomplish this, either the carrier is provided with a curved surface in the end region on which the leaf spring can initially roll off given an impact, or the leaf spring itself is curved concavely away from the carrier surface in the quiescent condition, so that it can roll off on a plane surface of the carrier. Given this roll-off event, the impact energy is converted into an elastic deformation of the spring before the spring reaches an edge at the end of the carrier. The deformation of the spring, which necessarily occurs when a relay is dropped, is thus influenced by the curvature of the roll-off section so that essentially only elastic deformation occurs, and the plastic deformations are limited to a minimum extent in case they still occur due to a broad tolerance position, for instance of an armature detent.

Advantageously, the curvature of the roll-off section at least approximately follows a circular arc whose radius of curvature satisfies the following conditions:

$$r \geq \frac{d \cdot E}{2 \cdot \sigma_{FB}},$$

whereby r indicates the radius of curvature, d indicates the thickness of the leaf spring, $\sigma_{FB}$ indicates the bending limit of the spring and E is the modulus of elasticity of the leaf spring.

When the length of the arcuate roll-off section amounts to 1, then the leaf spring, given impact, can move by a distance $$s = \frac{l^2}{2 \cdot r}$$

relative to the free end of its carrier without a plastic deformation occurring. In order to avoid such a plastic deformation, even given stronger blows, a detent is to be expediently provided that prevents further movement after a relative movement between the leaf spring and the carrier by the distance s.

The carrier preferably has a curved roll-off section. The curvature of the roll-off section can thus be formed by a bending of the carrier. In addition, it is also possible to form this curvature by a single-sided coining or deforming of the carrier. This is particularly advantageous when the curvature is to be fashioned at the armature, which is the carrier. In this case, a single-sided coining also reduces the mass of the armature, which will result in a reduced moment of inertia. As already mentioned, however, a roll-off section can also be formed by a bending of the leaf spring, and this is obtained by a prestress or bending away from the surface of the carrier.

As already mentioned, the yoke of the relay to which the leaf spring is secured in order to seat the armature at the free end of the yoke comes into consideration as a carrier. In this case, it is expedient that the play for the spring section is limited by a detent for the armature in the longitudinal direction thereof. When, by contrast, the carrier is the armature of the relay to which the leaf spring is secured in order to form a projecting contact spring section with a movable contact, then the play for this spring section is expediently limited by a detent transversely relative to the longitudinal direction of the armature. In both instances, the detent is expediently fashioned by being applied to a base body of the relay.

Other advantages and features of the invention will be readily apparent from the following description of the preferred embodiments, the drawings and claims.

DESCRIPTION OF THE PREFERRED EMBODIMENTS

Figure 1:
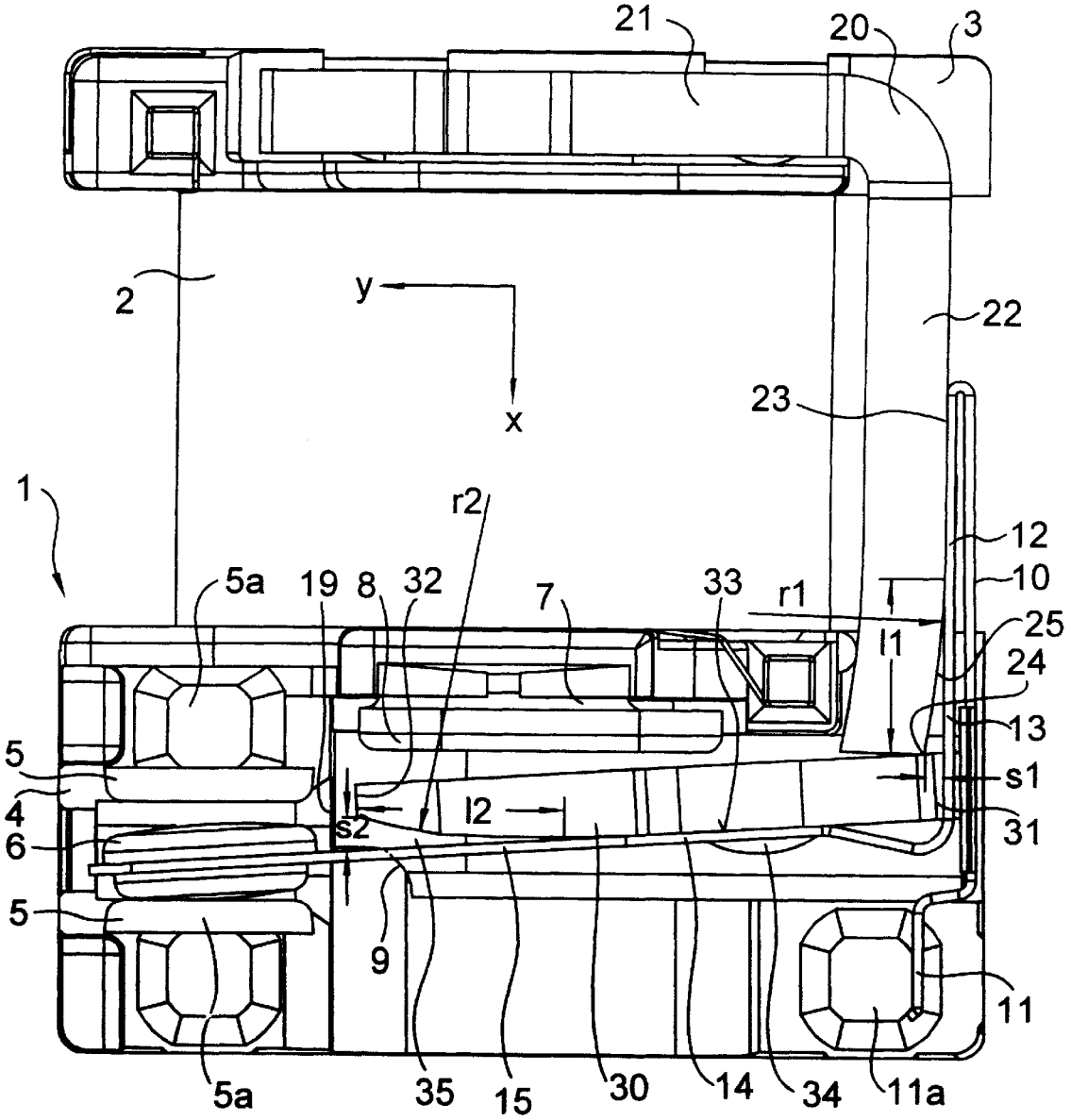
FIG. 1 is a plan view of the inventive relay.

In the standard way, the relay of FIG. 1 has a coil body, generally indicated at 1, which is formed by a coil 2, which extends between two flanges 3 and 4. A contact arrangement having two cooperating contacts 5 with termninals 5*a* and with a movable contact 6 extending therebetween at the end of a leaf spring 10 are arranged on the flange 4. A core 7 extends axially through the coil 2 in a way that cannot be seen. At one end, the core 7 is formed with a pull plate 8 and has its opposite end connected to a first leg 21 of an angled-off or right-angle bent yoke 20, whose second leg 22 extends approximately parallel to the coil axis next to the coil. An approximately plate-shaped armature 30 that forms a working air gap with the pull plate 8 is seated at the free end 24 of the yoke leg 22.

The leaf spring 10, which serves in a known way both as an armature holding spring as well as a contact spring, has a terminal leg 11 that is connected to a terminal pin 11*a*. Another or second leg 12 is secured to a planar seating section 23 of the yoke leg 22, whose continuation extends beyond the free end 24 of the yoke leg 22 in the same plane as an unsecured spring section 13 that arcuately spans the bearing end 31 of the armature 30 and has a further fastening section 14 secured to a seating section 33 of the armature 30. The extension of the fastening section 14 has an unsecured spring section 15, which carries the movable contact 6 at its free end, which extends beyond the free end 32 of the armature into the region between the stationary cooperating contacts 5.

The fastening section 12 is connected by a weld to the seating section 23 of the yoke. The fastening section 14 is connected by a rivet 34 to the seating section 33 of the armature 30. In both instances, some other type of fastening would be possible and is conceivable.

When, due to an impact, the relay experiences a pronounced acceleration, then both the spring section 13 in the region of the end 24 of the yoke leg 22 as well as the spring section 15 in the region of the armature end 32 could be plastically deformed if these ends were respectively fashioned as edges of a planar section in a traditional way. According to the present invention, the free end section of the yoke leg 22 is convexly curved by bending of the yoke leg so that a roll-off section 25 having a length 11 is formed. In this same way, the free end of the armature 30 is likewise convexly curved by a coining at its outer surface so that a roll-off section 35 having a length 12 is formed. In both instances, a wedge-shaped roll-off region occurs between the roll-off region and the leaf spring.

Let two possible impact directions x and y be considered for explaining the function of the inventive construction of the yoke and armature, and impact blows in these impact directions x and y respectively causing relative motion of the movable relay parts, namely the armature 30 and the leaf spring 10.

When an excursion of the armature in the x-direction caused by a blow occurs, the unsecured spring section 15 can roll off guided along the roll-off section 35 and can be bent elastically without exceeding the bending limit of the spring material. Due to a detent 9 for the armature in the housing, it is ultimately assured that the armature comes to a standstill before the spring section 15 has reached the armature end 32. Accordingly, it can no longer be plastically bent over the remaining edge at the free end 32 of the armature.

When, by contrast, a blow occurs as a result whereof the armature is deflected in the longitudinal direction, namely the y-direction, then the spring section 13 can roll off guided along the roll-off section 25 of the yoke leg 22 and can elastically bend without thereby exceeding the bending limit of the spring material. An end detent 19 in the housing against which the free end 32 of the armature 30 strikes before the spring section 13 has reached the sharp yoke end 24 also exists here at a tolerance-secured distance.

The roll sections 25 and 34 preferably have a circular arcuate curvature, whereby the radius r1 of the roll section 25 and the radius r2 of the roll section 35, respectively, satisfy the above-mentioned condition:

$$r \geq \frac{d \cdot E}{2 \cdot \sigma_{FB}}$$

The motion latitude between the spring section 13 and the end 24 of the armature is referenced as s1 and the motion latitude between the spring section 15 and the armature end 32 is referenced s2. The path s that the armature can traverse in both impact directions up to the detent 9 or, respectively, 19 without having a plastic deformation of the shaped spring occurring is also respectively dimensions according to this play. Thus, the values for sl and s2 are:

$$s1 = \frac{(l1)^2}{2 \cdot r1} \qquad s2 = \frac{(l2)^2}{2 \cdot r2}.$$

Figure 2:
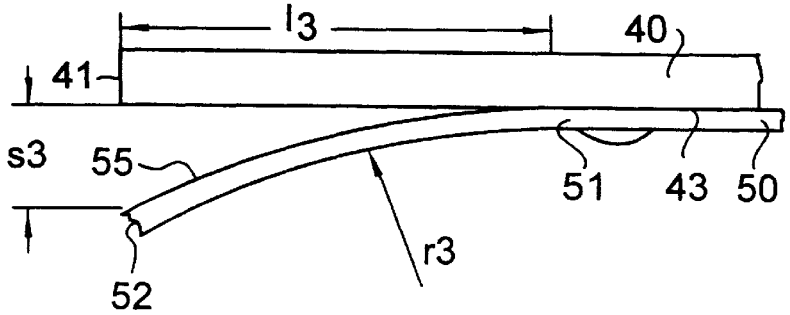
FIG. 2 is a schematic detailed illustration of a carrier which may be either the armature or yoke with a convexly curved leaf spring section.

As initially mentioned, the roll-off region can also be formed in that the leaf spring, which is concavely curved away from its carrier, which may be either the armature or the yoke. Such an embodiment is schematically shown in FIG. 2. This shows a carrier 40 that can be either the armature or the yoke leg with a seating section 43 on which a leaf spring 50 is secured in its function as an armature bearing spring or as a contact spring with a fastening section 51. This leaf spring has a spring section 52 projecting beyond the free end 41 of the carrier 40 that forms a concavely curved roll-off section 55 having a length 13. As a result, there is a wedge-shaped roll-off region having a length 13. In this case, too, the spring can roll off over the entire roll-off region of the carrier 40 given a relative motion.

Of course, it is clear to a person skilled in the art that the roll-off section at the yoke with the armature spring and the roll-off section at the armature end with a contact spring can be respectively employed independently of one another when, for example, no common leaf spring is provided for the armature bearing and for the contacting.

Although various minor modifications may be suggested by those versed in the art, it should be understood that we wish to embody within the scope of the patent granted hereon all such modifications as reasonably and properly come within the scope of our contribution to the art.

We claim:

1. An electromagnetic relay having a contact arrangement and a magnet system, said magnet system comprising a yoke and an armature movably seated on the yoke, a leaf spring that respectively has a fastening section secured to lie planarly on a planar seating section of a respective, rigid carrier formed by one of the yoke and armature and respectively having an adjoining, unsecured spring section extending beyond a free end of the carrier, said spring section having a predetermined motion latitude extending perpendicular to the plane of the fastening section, the improvements comprising a roll-off region for the leaf spring having a wedge shape in the quiescent condition being provided between the seating section and the free end of the carrier, said roll-off region being formed by a convex curvature of a roll-off section selected from the carrier and the leaf spring away from the plane of the seating surface, the roll-off section having at least a radius of curvature that satisfies the condition $$r \geq \frac{d \cdot E}{2 \cdot \sigma_{FB}}$$

with r equaling the radius of curvature of the roll-off section; d equaling the thickness of the leaf spring; $\sigma_{FB}$ equaling the spring bending limit of the leaf spring; and E equaling the modulus of elasticity of the leaf spring, the motion latitude between the leaf spring and the carrier at the open end of the roll-off region being limited by a fixed detent according to the following relationship:

$$s = \frac{l^2}{2 \cdot r}$$

with s equaling the motion latitude of the leaf spring relative to the free end of the carrier; 1 equaling the length of the roll-off section; and r equaling the radius of curvature.

2. An electromagnetic relay according to claim 1, wherein the curvature of the roll-off section is formed by bending of the carrier.

3. An electromagnetic relay according to claim 2, wherein the carrier is a yoke of the relay, the armature of the relay being secured to a projecting spring section and the play of the spring section being limited by a detent for the armature in the longitudinal direction thereof.

4. An electromagnetic relay according to claim 3, which includes a second carrier which is an armature of the relay and the movable contact is secured to a projecting spring section, the play of the spring section is limited by a detent transversely relative to the longitudinal direction of the armature.

5. An electromagnetic relay according to claim 1, wherein the curvature of the roll-off section is formed by a single-side coining of the carrier.

6. An electromagnetic relay according to claim 5, wherein the carrier is the yoke of the relay and the armature of the relay is secured to a projecting spring section, the play for the spring section being limited by a detent for the armature in a longitudinal direction.

7. An electromagnetic relay according to claim 6, which includes a second carrier being the armature of the relay, the movable contact being secured to a projecting spring section and the play for the spring section being limited by a detent transversely relative to the longitudinal direction of the armature.

8. An electromagnetic relay according to claim 1, wherein the curvature of the roll-off section is formed by a pre-bending of the leaf spring.

9. An electromagnetic relay according to claim 8, wherein the carrier is the yoke of the relay, the armature of the relay is secured to a projecting spring section, the play for the spring section is limited by a detent for the armature in the longitudinal direction.

10. An electromagnetic relay according to claim 9, which includes a second carrier formed by the armature of the relay, a movable contact is secured to the projecting spring section and the play of the spring section is limited by a detent transversely relative to the longitudinal direction of the armature.

11. An electromagnetic relay according to claim 1, wherein the curvature of the roll-off section is formed by bending of the carrier.

12. An electromagnetic relay according to claim 1, wherein the curvature of the roll-off section is formed by a single-sided coining of the carrier.

13. An electromagnetic relay according to claim 1, wherein the curvature of the roll-off section is formed by a pre-bending of the leaf spring.

14. An electromagnetic relay according to claim 1, wherein the carrier is a yoke of the relay and the armature of the relay is secured to a projecting spring section, and the play of the spring section is limited by a detent for the armature in the longitudinal direction.

15. An electromagnetic relay according to claim 14, which includes a second carrier being the armature of the relay, a movable contact being secured to the projecting spring section and the play for the spring section being limited by a detent extending transversely relative to the longitudinal direction of the armature.

16. An electromagnetic relay according to claim 1, wherein the carrier is the armature of the relay, a movable contact is secured to the projecting spring section and the play for the spring section is limited by a detent extending transversely relative to the longitudinal direction of the armature.

* * * * *